US009650821B2

(12) United States Patent
Williams

(10) Patent No.: US 9,650,821 B2
(45) Date of Patent: May 16, 2017

(54) HINGE ASSEMBLY

(71) Applicant: THE ALUMINIUM LIGHTING COMPANY LIMITED, Port Talbot (GB)

(72) Inventor: Craig Williams, Swansea (GB)

( * ) Notice: Subject to any disclaimer, the term of this patent is extended or adjusted under 35 U.S.C. 154(b) by 31 days.

(21) Appl. No.: 14/787,260

(22) PCT Filed: Mar. 25, 2014

(86) PCT No.: PCT/GB2014/000112
§ 371 (c)(1),
(2) Date: Oct. 26, 2015

(87) PCT Pub. No.: WO2014/174231
PCT Pub. Date: Oct. 30, 2014

(65) Prior Publication Data

US 2016/0069114 A1 Mar. 10, 2016

(30) Foreign Application Priority Data

Apr. 26, 2013 (GB) ..... 1307591.6

(51) Int. Cl.

| | |
|---|---|
| ***E05D 11/00*** | (2006.01) |
| ***E04H 12/18*** | (2006.01) |
| ***E05D 11/10*** | (2006.01) |
| ***F21V 21/12*** | (2006.01) |

(52) U.S. Cl.
CPC ..... *E05D 11/0054* (2013.01); *E04H 12/187* (2013.01); *E05D 11/0081* (2013.01); *E05D 11/1014* (2013.01); *F21V 21/12* (2013.01); *E05D 2011/0072* (2013.01)

(58) Field of Classification Search
CPC . E05D 11/00; E05D 11/0054; E05D 11/0081; E05D 11/1014; E05D 2011/0072; E05D 5/08
USPC ..... 16/250, 251
See application file for complete search history.

(56) References Cited

U.S. PATENT DOCUMENTS

| | | | | |
|---|---|---|---|---|
| 1,483,588 | A * | 2/1924 | Simmons | F21V 21/088 16/DIG. 4 |
| 2,441,689 | A * | 5/1948 | Daniel | A45B 17/00 135/74 |
| 2,577,811 | A * | 12/1951 | Rutledge | E04H 12/187 16/250 |
| 2,645,511 | A * | 7/1953 | Rutledge | E04H 12/187 403/119 |
| 5,746,533 | A * | 5/1998 | Schmidt | E05D 11/1007 16/319 |
| 8,584,993 | B2 * | 11/2013 | Pumford | E04H 12/187 135/20.1 |

(Continued)

FOREIGN PATENT DOCUMENTS

| | | |
|---|---|---|
| EP | 0325311 A1 | 7/1989 |
| GB | 2224292 A | 5/1990 |

(Continued)

*Primary Examiner* — Roberta Delisle
(74) *Attorney, Agent, or Firm* — AEON Law; Adam L.K. Philipp

(57) ABSTRACT

A hinge assembly for connecting together upper and lower separable sections of a column comprises an upper member for attachment to the lower end of an upper column section and a lower member for attachment to the upper end of a lower column section.

15 Claims, 7 Drawing Sheets

(56) References Cited

U.S. PATENT DOCUMENTS

| | | | | |
|---|---|---|---|---|
| 2004/0036222 | A1* | 2/2004 | Chou | A63B 63/004 273/407 |
| 2004/0145141 | A1 | 7/2004 | Dennis | |

FOREIGN PATENT DOCUMENTS

| | | | |
|---|---|---|---|
| GB | 2411913 | A | 9/2005 |
| GB | 2458393 | A | 9/2009 |
| WO | 2005/088035 | A | 9/2005 |

* cited by examiner

HINGE ASSEMBLY

FIELD OF THE INVENTION

The present invention relates to a hinge assembly, particularly a hinge assembly for use with a column, such as a lighting column.

The invention further relates to such a column which includes a hinge assembly which enables the upper column section to pivot relative to the lower column section from a vertical position to a generally horizontal position to provide ready access at ground level to an electrical appliance, such as a lighting unit, located on the upper end of the upper column section.

Whereas the invention will be described below with particular reference to a lighting column, it is to be understood that the invention also has application to other species of column which support other forms of electrically operated equipment such as cameras.

BACKGROUND TO THE INVENTION

Most lighting columns comprise a lighting unit (hereinafter referred simply as a lamp unit) supported by a rigid hollow column through which cabling passes for connecting the lamp unit to a ground located power source, conventionally underground cabling from a mains source of electricity. With such lighting columns, when access is required to the top of the column to, for example, service, repair or replace a lamp unit, this is conventionally achieved either by employing a sky-lift or, where road access is limited to inhibit or prevent such use, by an operator climbing a ladder supported by the column. Recent legislation has recommended against the use of ladders to service lighting columns for a variety of reasons.

To address this and other problems, lighting columns have been developed in which the upper lamp unit supporting section of the column is pivotally secured to the lower ground supported column section through a hinge assembly. In such columns access at ground level to the upper column section and the lamp unit is achieved by causing the upper section of the column to pivot about the hinge assembly relative to the lower section.

An important criterion for any such column is to ensure that the presence of the hinge assembly which enables the upper column section to pivot relative to the column lower section does not present an area of structural weakness within the column during occasions when the column is subject, for example, to high wind loads which will vary depending on the geographical location of the installation. It is also important to ensure that when the upper column section is in its lowered position, it is secured against returning to its upright position until released to do so.

Applicant's patent GB2458393 discloses a column and hinge assembly which meet these criteria. This earlier patent discloses a hinge assembly which comprises an upper member pivotally attached to a lower member for movement about a generally horizontal axis. The upper part of the hinge assembly is secured to an upper section of a lighting column and the lower part of the hinge assembly is secured to a lower section of the column. In use, movement of the upper hinge part about the pivot axis from a normal position, in which the upper section of the column is relatively upright, causes the upper section of the column to rotate about the hinge axis thereby allowing the upper section of the column to be moved a generally horizontal maintenance position. The hinge assembly includes a cover rotatable about a generally vertical axis between a first position in which the cover impairs pivotal motion of the upper hinge assembly part and a second position in which such pivotal motion is permitted.

Whereas this hinge assembly works well in practise, the present invention sets out to provide an improved hinge assembly having enhanced resistance to wind loading together with an ability readily to increase the structural capacity of the cover sections to facilitate additional increased wind loading. Hinge assemblies in accordance with the invention have the advantage over known assemblies including that disclosed in GB2458393 or preventing unwanted pivoting of the upper hinge member and a column section connected thereto when the column section is in its generally horizontal position.

SUMMARY OF THE INVENTION

In one aspect the present invention provides a hinge assembly for connecting together upper and lower separable sections of a column, the hinge assembly comprising an upper member for attachment to the lower end of an upper column section and a lower member for attachment to the upper end of a lower column section, a hinge which connects the upper and lower members of the hinge assembly to permit pivotal movement of the upper hinge member about a first axis from a generally vertical position to or towards a generally horizontal position whereby an upper column section connected to the upper member can move from a generally vertical position towards or to a generally horizontal position, and a plurality of cover members positioned about the entire circumference of the upper and lower members of the hinge with each cover member connected for pivotal movement relative to the hinge about a generally horizontal second axis which is positioned at or close to its lower edge, whereby each such cover member can pivot relative to the lower member of the hinge to expose the upper and lower hinge members and to enable the upper hinge member and column section attached thereto to pivot from its initial generally vertical position to a generally horizontal position, one such cover member then being pivotal to a locking position in which it engages a lower part of the upper hinge member to prevent unwanted further pivoting of the upper hinge member and a column section connected thereto.

In a preferred embodiment, two generally semi-circular cover members are provided.

Locking means may be provided to secure the cover members in place about the circumference of the hinge when in its non-pivoted position.

Each cover member preferably has a thickened band of material along its upper and lower margins which, in the closed positions of the cover members, lie in contact with adjoining surfaces of compressible pads positioned on the hinge assembly whereby external loads (for example wind loads) applied to the column are transmitted through the hinge assembly to column sections secured to the lower and upper ends of the hinge assembly. The compressible pads act to dampen small movements of the assembly and take up any potential manufacturing tolerances.

The section of the thickened bands may be increased to accommodate different expected wind loads either during manufacture of the assembly or subsequently retro-fitted to an installed assembly by replacing the existing cover members.

In accordance with a second aspect of the present invention there is provided a column which includes a hinge assembly as described in the five preceding paragraphs.

The column may comprise a lighting column.

In this aspect, the upper hinge assembly member may be integral with the upper section of a column, and the lower hinge assembly member may be integral with the lower section of a column. This need not, however, be the case. Thus, the upper and lower hinge assembly members may include tubular inserts for location within the hollow ends of column members.

This permits conversion of an unhinged column into a hinged one.

BRIEF DESCRIPTION OF THE DRAWINGS

The invention will now be described by way of example only with reference to the accompanying diagrammatic drawings in which:—

DETAILED DESCRIPTION OF THE INVENTION

Figure 1:
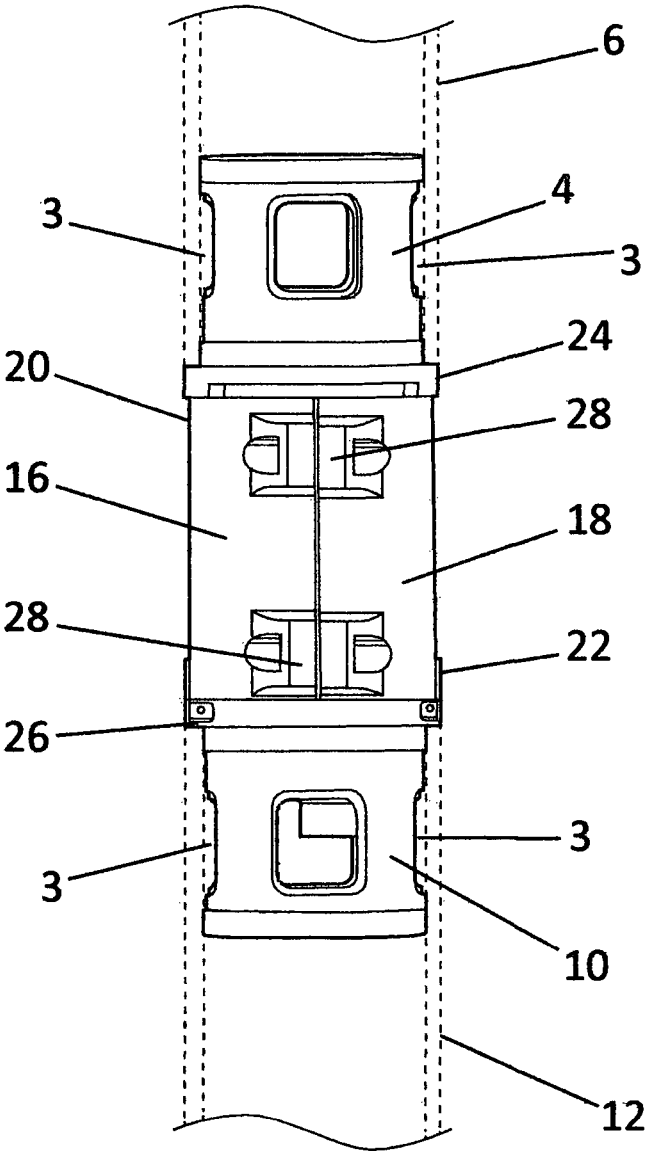
FIG. 1 is a side view of a hinge assembly in accordance with the invention for connecting upper and lower column sections with its cover members in their unopened positions.

The hinge assembly illustrated in FIGS. 1 to 6 is for connecting together the upper and lower sections of a column, especially a hollow lighting column. The column sections are typically produced from aluminium as an extrusion of a 6000 series alloy, such as ISO EN AW-6063.

The hinge assembly includes an upper member 2 which includes a substantially tubular part 4 of generally circular section and which, in use, locates as a tight friction fit within the lower end of the upper section 6 of a hollow column (shown in broken line in FIG. 1) to secure the upper member 2 to the upper column section 6. The hinge assembly further includes a lower member 8 which includes a tubular part 10 of generally circular section which, in use, locates as a tight friction fit within the upper end of the lower section 12 of the column to secure the lower hinge member 8 to the lower column section 12.

As will be seen from FIG. 1, annular cavities 3 are provided between the adjoining sides of the upper and lower column sections 6, 12 and the tubular parts 4 and 10 of the hinge assembly. After assembly of these tubular parts within the open ends of the column sections 6, 12, a bonding agent is pumped into the cavities through holes drilled in the column sections 6, 12.

Figure 3:
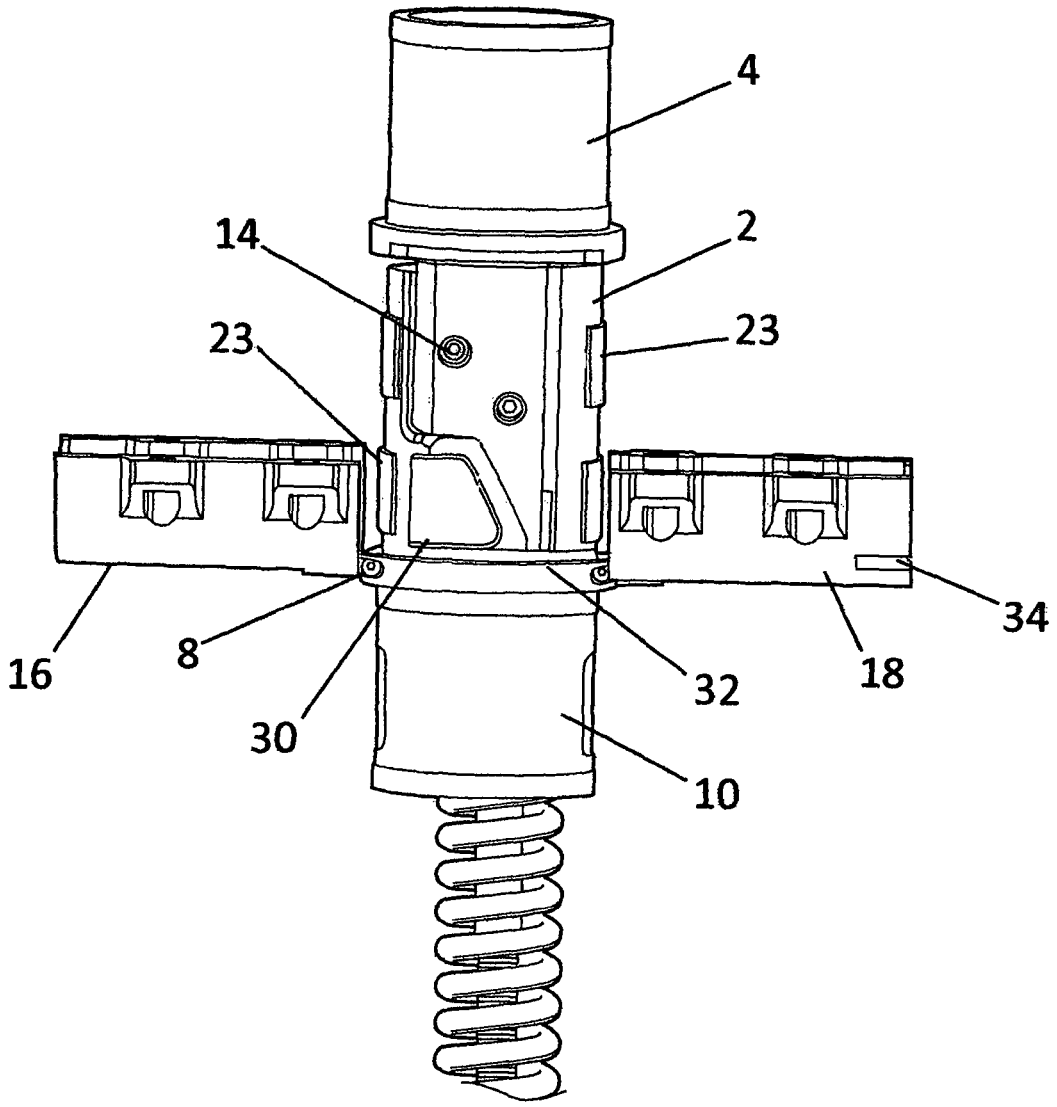
FIG. 3 is a side view of the hinge assembly illustrated in FIG. 2 in a first open position with its cover members in their fully open positions.
Figure 4:
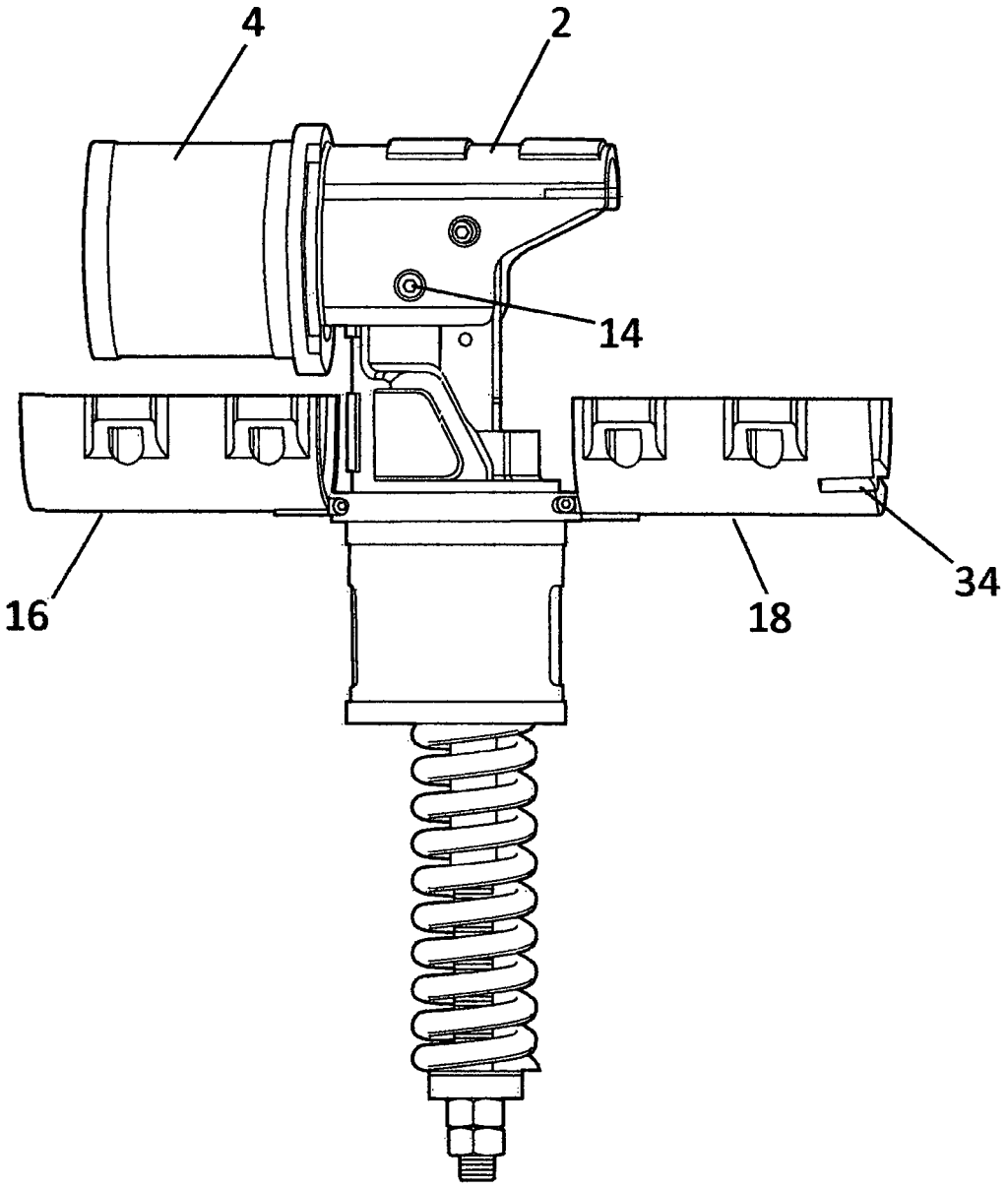
FIG. 4 is a side view of the hinge assembly illustrated in FIG. 2 in a second open position.

The hinge members 2, 8 are connected for rotation about an axle 14 (see FIGS. 3 and 4).

The hinge assembly is shown in its non-pivoted upright position in FIG. 3 and its pivoted inclined position in FIG. 4.

The hinge members 2, 8 are typically produced from a heat-treated case aluminium alloy, such as LM25 and are hollow to allow electrical cabling to pass from a source of electricity at below ground level to a lamp unit located on the top of the upper column section 6.

As will be seen from the drawings, semi-circular cover members in the form of doors 16, 18 are positioned about the circumference of the hinge assembly when the latter is in its upright position. These doors entirely surround the outer circumference of the hinge assembly when in its upright position.

Each door has a thickened band of material 20, 22 along its upper and lower semi-circular boundaries, and the upper and lower margins of the doors respectively abut against compressible pads 23 secured to the internal faces of annular flanges 24, 26 located around the lower and upper margins of the parts 4 and 10. The bands 20, 22 and the abutment of the upper and lower edges of the doors with the flanges 24, 26 ensure that all forces applied to the column as a result of, for example, wind loads are transmitted through the hinge assembly and into the column sections 6, 12.

Figure 2:
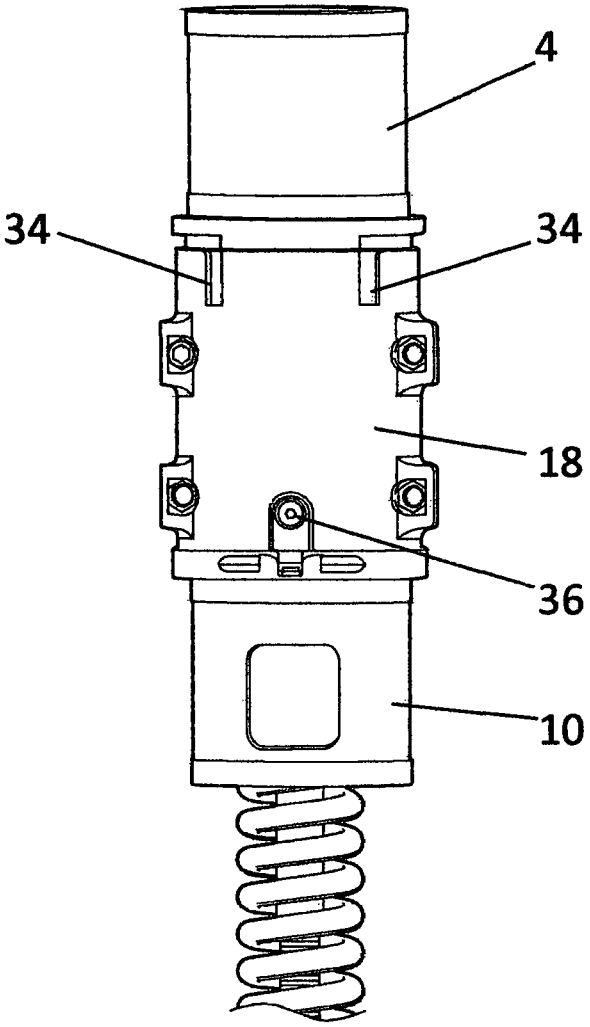
FIG. 2 is a rear view of the hinge assembly illustrated in FIG. 1 attached to a helical spring which forms part of apparatus which limits the rate of movement of hinge assembly during operation thereof.

When in the position shown in FIGS. 1 and 2, the doors 16, are secured in place by anti-tamper locking bolts which pass through bore holes present in co-operating locking members 28. Two such locking members are positioned on each side of each door, one above the other. The locking members ensure that the doors are securely clamped about the periphery of the hinge assembly. In their closed positions, the doors provide the main structural element of the assembled lighting column.

The doors 16, 18 are supported at their lower edges on hinges (see FIGS. 3 to 5) which have a limited ability to move horizontally towards and away from the central vertical axis of the hinge assembly. Thus, when the locking bolts are tightened the hinges are moved inwardly to cause the doors to engage firmly one with the other and when the locking bolts are released to cause the doors to be sufficiently disengaged to enable the doors to pivot about the hinges to the positions shown in FIG. 3.

To achieve these horizontal movements, the hinges 30 are located on tracks supported on an annular lip 32 (see FIG. 3) positioned around the lower end of the hinge member 8. These movements of the hinges ensure that when the doors are closed and locked in place, the clamping force applied to the hinge assembly is spread equally through the assembly. Once the locking members 28 have been released to facilitate opening of the doors, the hinge mechanisms track horizontally over the lip in a direction away from the hinge assembly thereby enabling the doors to rotate about the hinge mechanisms to the positions shown in FIG. 3. This arrangement ensures that the base of each door sits squarely on the annular flange 24 so that forces are transmitted equally through the lower column section 12.

As will be seen from FIG. 3, the doors 16, 18, when pivoted, are positioned fully away from the hinge members 2, 8 to enable the upper hinge member 2 to pivot about the axle 14 to the generally horizontal position shown in FIG. 4. In this position, ready access is enabled to a lamp unit located on the column upper section 6 of the column for servicing or replacement by an operative at ground level.

Figure 5:
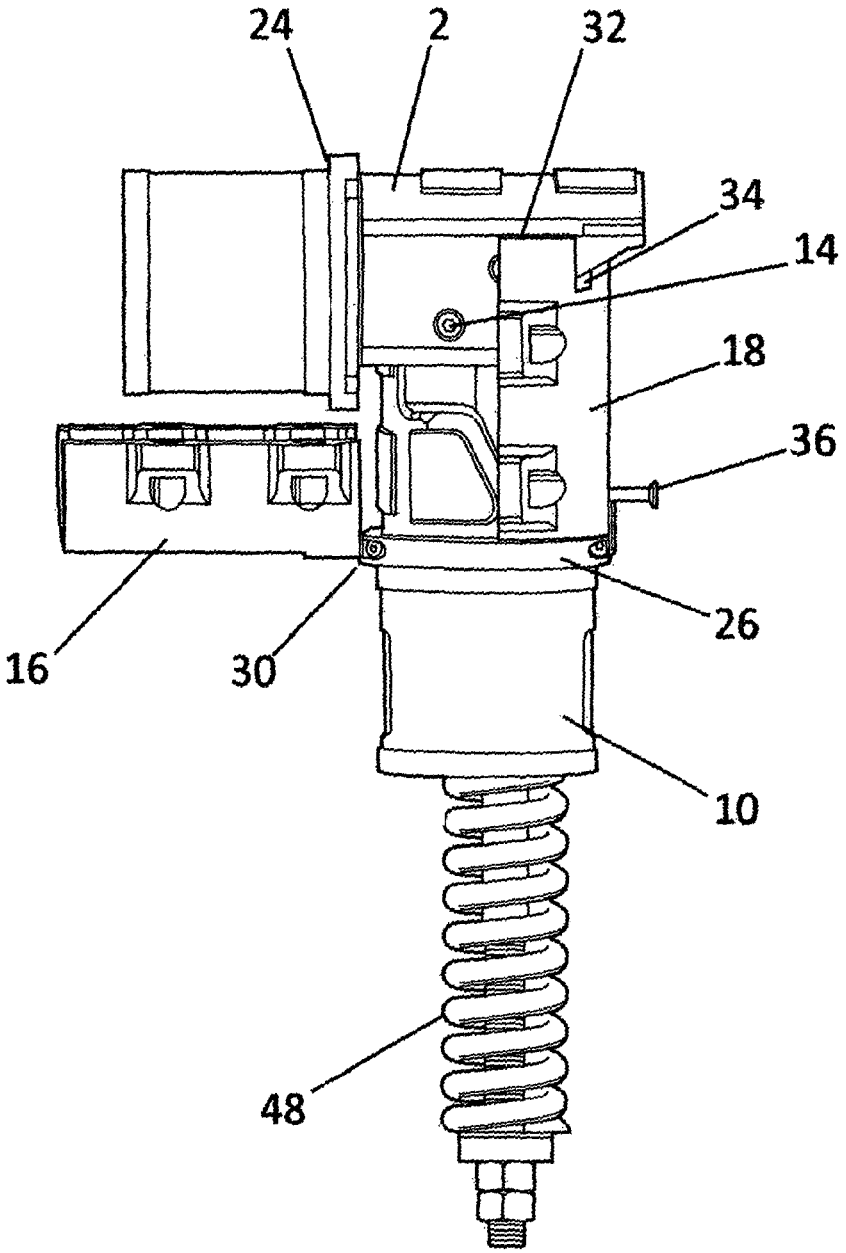
FIG. 5 is a side view of the hinge assembly illustrated in FIG. 2 in a third fully open position.

When the upper hinge member 2 and the attached column section 6 are in the generally horizontal position shown in FIG. 4, the door 18 is moved to the generally vertical position shown in FIG. 5 in which side edges of the hinge member 2 locate within grooves 34 formed in the upper end of the rear of the door 18. The door thereby provides secure support for the hinge member 2 when in its generally horizontal position. Once the hinge member is in this generally horizontal position, a locking bolt 36 or the like is located within a bore formed in the side of the door 18 and the adjoining surface of the hinge assembly to prevent any attempt by the upper hinge member 2 and the upper column section 6 to move away from the position shown in FIG. 5. Such movement can, for example, occur if a lamp unit is removed from the upper column section 6 thereby affecting the counter balance of the column section.

After completion of the servicing or replacement of the lamp unit, the locking bolt 36 is removed and the door 18 pivoted away from the hinge assembly to enable the upper hinge member 2 and the column section 6 to pivot about the axle 14 and to return to its generally vertical position.

Figure 6:
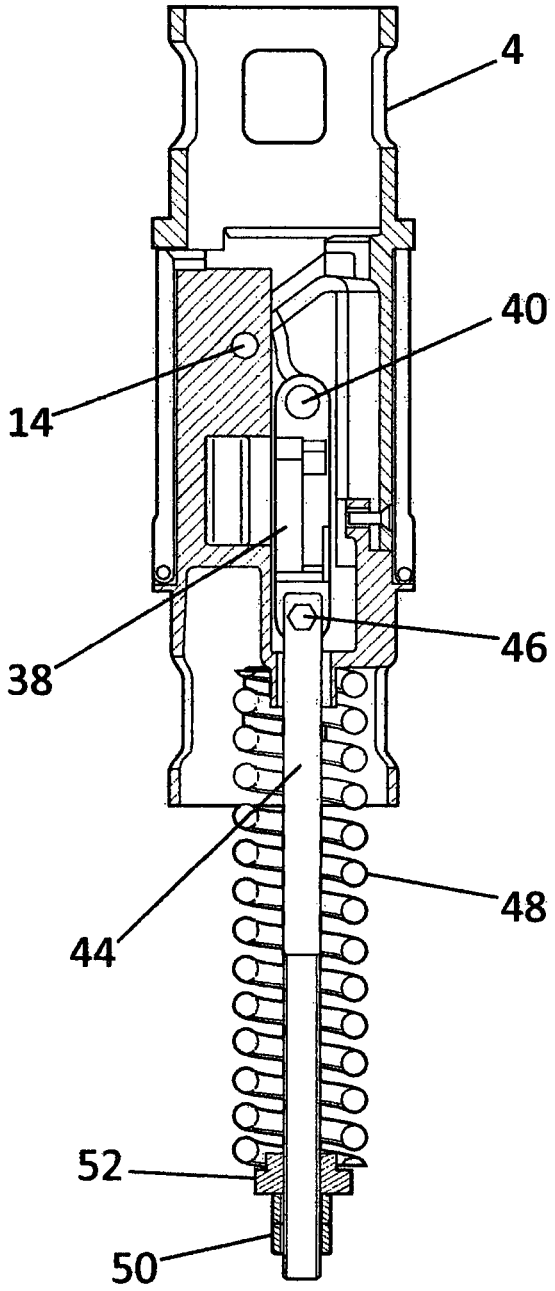
FIG. 6 is a section taken through the hinge assembly illustrated in FIG. 2.
Figure 7:
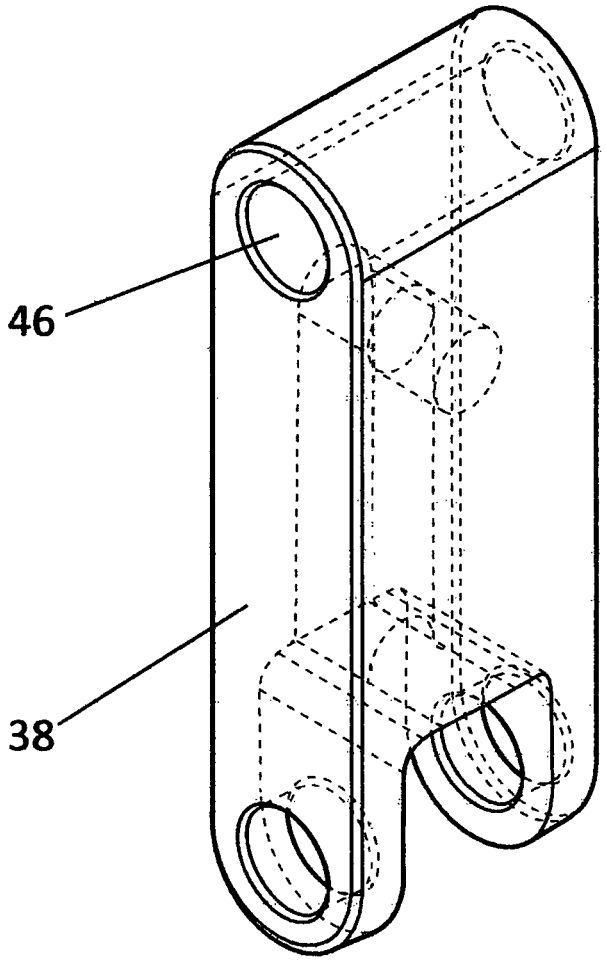
FIG. 7 is a perspective view of a link arm which forms part of the illustrated hinge assembly.

As will be seen from FIG. 6, the upper hinge member 2 is pivotally attached to a link arm 38 through an axle 40 located in a bore 46 (see FIG. 7) provided in the upper hinge member 2. The axle 40 lies generally parallel to the axle 14 about which the upper hinge member 2 rotates. The link arm 38 is generally elongate in shape and is typically made from a heat treated cast aluminium alloy, typically LM25.

The link arm 38 is also pivotally connected to one end of a rod 44 by a second link arm axle 46. The rod 44 passes through the interior space defined by a helical spring 48 and is provided at its other end with a threaded portion on which is mounted a nut 50. The nut abuts a spring control disk 52.

In an alternative arrangement, the link arm 38 is replaced by a solid member into which the upper end of the rod 44 extends. The rod 44 is externally threaded and is retained within the solid member by a trapped nut insertable into the member through a suitably positioned opening. The solid member is formed with a through-hole similar to the through hole 46 through which the axle 40 passes.

The lengths of the spring, the rod and the spring control disc are arranged to maintain the spring in compression at all times.

In the position of the hinge assembly shown in FIG. 1, the longitudinal axis of the link arm 38 is generally parallel to the longitudinal axis of the column 6, 12 in its vertical position.

When the upper column section is to be tilted to provide ready access at ground level to a lamp unit, the locking members 28 are released to enable the doors 16, 18 to pivot to their fully pivoted positions shown in FIG. 3. The upper hinge member 2 is then able to pivot about the axle 14 but will not do so until a relatively small force is applied to the upper hinge member 2 for reason that the spring 48 is compressed.

Once the hinge assembly has been broken, the upper hinge member 2 pivots relative to the lower hinge member 8. This pivotal movement causes the link arm axle 40 to rise which in turn causes the link arm axle 46 to rise. This causes the rod 44 and the control disc 52 to move upwardly in a direction generally parallel to the longitudinal axis of the rod 44. This movement compresses the spring 48 thereby increasing the resistive force exerted by the spring on the upper hinge member 2.

As the angle between the longitudinal axes of the upper and lower hinge members 2, 8 increases, so the displacement of the link arm 38 also increases thereby increasing the resistive force which works against the increase in pivotal movement of the upper hinge member 2 away from its generally vertical position. This provides a smooth, controlled motion of the upper column member 6 throughout the pivot action.

The degree of compression in the spring 48 can be varied by moving the nut 50 along the rod 44 whereby the motion of the upper column section 6 can be optimised.

Once the upper column section 6 has been lowered, the door 18 is moved about its hinge 32 to the position shown in FIG. 4 in which it engages an under surface of the upper hinge member 2 enter the slots 34 formed in the rear of the door 18. The locking bolt is then engaged. A small amount of movement of the upper hinge member 2 is possible should this be required during servicing or replacement of the lamp unit.

Once the required work has been completed, the locking nut 36 is disengaged and the door 18 pivoted away from the hinge assembly to a position equivalent to that of door 16. A small force exerted on the upper column section 6 or the upper hinge member 2 is then sufficient to cause the upper column section to return slowly to its generally vertical position. During this procedure the amount of compression in the spring 48 decreases to produce a slow, controlled return to the generally vertical position.

The arrangement of the spring 48, the rod 52 and the control disc is disclosed in our granted United Kingdom patent 2458393B and insofar as this patent describes this arrangement (but for no other purpose) its disclosure is incorporated by reference.

It will be appreciated that the foregoing is merely descriptive of one embodiment of this invention and that modifications can readily be made to this embodiment without departing from the true scope of the invention as set out in the appended claims.

The invention claimed is:

1. A hinge assembly for connecting together upper and lower separable sections of a column, the hinge assembly comprising an upper member for attachment to the lower end of an upper column section and a lower member for attachment to the upper end of a lower column section, a hinge which connects the upper and lower members of the hinge assembly to permit pivotal movement of the upper hinge member about a first axis from a generally vertical position to or towards a generally horizontal position whereby an upper column section connected to the upper member can move from a generally vertical position towards or to a generally horizontal position, the assembly being characterized in that it comprises a plurality of cover members positioned about the entire circumference of the upper and lower members of the hinge with each cover member connected for pivotal movement relative to the hinge about a generally horizontal second axis which is positioned at or close to its lower edge, whereby each such cover member can pivot relative to the lower member of the hinge to expose the upper and lower hinge members and to enable the upper hinge member and column section attached thereto to pivot from its initial generally vertical position to a generally horizontal position, one such cover member then being pivotal to a locking position in which it engages a lower part of the upper hinge member to prevent unwanted further pivoting of the upper hinge member and a column section connected thereto.

2. A hinge assembly as claimed in claim 1 characterized in that two generally semi-circular cover members are provided.

3. A hinge assembly as claimed in claim 2 characterized in that locking means is provided to secure the cover members in place about the circumference of the hinge when in its non-pivoted position.

4. A hinge assembly as claimed in claim 3 characterized in that each cover member has a thickened band of material along its upper and lower margins which, in the closed positions of the cover members, lie in contact with compressible pads secured to the adjoining surfaces of the hinge assembly whereby external loads applied to the column are transmitted through the hinge assembly to column sections secured to the lower and upper ends of the hinge assembly.

5. A hinge assembly as claimed in claim 2 characterized in that each cover member has a thickened band of material along its upper and lower margins which, in the closed positions of the cover members, lie in contact with compressible pads secured to the adjoining surfaces of the hinge assembly whereby external loads applied to the column are transmitted through the hinge assembly to column sections secured to the lower and upper ends of the hinge assembly.

6. A hinge assembly as claimed in claim 1 characterized in that locking means is provided to secure the cover members in place about the circumference of the hinge when in its non-pivoted position.

7. A hinge assembly as claimed in claim 6 characterized in that each cover member has a thickened band of material along its upper and lower margins which, in the closed positions of the cover members, lie in contact with compressible pads secured to the adjoining surfaces of the hinge assembly whereby external loads applied to the column are transmitted through the hinge assembly to column sections secured to the lower and upper ends of the hinge assembly.

8. A hinge assembly as claimed in claim 1 characterized in that each cover member has a thickened band of material along its upper and lower margins which, in the closed positions of the cover members, lie in contact with compressible pads secured to the adjoining surfaces of the hinge assembly whereby external loads applied to the column are transmitted through the hinge assembly to column sections secured to the lower and upper ends of the hinge assembly.

9. A column which includes a hinge assembly for connecting together upper and lower separable sections of a column, the hinge assembly comprising an upper member for attachment to the lower end of an upper column section and a lower member for attachment to the upper end of a lower column section, a hinge which connects the upper and lower members of the hinge assembly to permit pivotal movement of the upper hinge member about a first axis from a generally vertical position to or towards a generally horizontal position whereby an upper column section connected to the upper member can move from a generally vertical position towards or to a generally horizontal position, the assembly being characterized in that it comprises a plurality of cover members positioned about the entire circumference of the upper and lower members of the hinge with each cover member connected for pivotal movement relative to the hinge about a generally horizontal second axis which is positioned at or close to its lower edge, whereby each such cover member can pivot relative to the lower member of the hinge to expose the upper and lower hinge members and to enable the upper hinge member and column section attached thereto to pivot from its initial generally vertical position to a generally horizontal position, one such cover member then being pivotal to a locking position in which it engages a lower part of the upper hinge member to prevent unwanted further pivoting of the upper hinge member and a column section connected thereto.

10. A column as claimed in claim 9, wherein the hinge assembly is characterized in that two generally semi-circular cover members are provided.

11. A column as claimed in claim 10, wherein the hinge assembly is characterized in that locking means is provided to secure the cover members in place about the circumference of the hinge when in its non-pivoted position.

12. A column as claimed in claim 11, wherein the hinge assembly is characterized in that each cover member has a thickened band of material along its upper and lower margins which, in the closed positions of the cover members, lie in contact with compressible pads secured to the adjoining surfaces of the hinge assembly whereby external loads applied to the column are transmitted through the hinge assembly to column sections secured to the lower and upper ends of the hinge assembly.

13. A column as claimed in claim 9, characterized in that it comprises a lighting column.

14. A column as claimed in claim 13, characterized in that the upper hinge assembly member is integral with the upper section of a column, and the lower hinge assembly member is integral with the lower section of a column.

15. A column as claimed in claim 13, characterized in that the upper and lower hinge assembly members include tubular end pieces for location within the hollow ends of upper and lower column sections.

* * * * *